US011396881B2

(12) United States Patent
Ying

(10) Patent No.: US 11,396,881 B2
(45) Date of Patent: Jul. 26, 2022

(54) BLADELESS FAN AND AIR OUTLET CYLINDER THEREOF

(71) Applicant: Hui Ying, Zhejiang (CN)

(72) Inventor: Hui Ying, Zhejiang (CN)

( * ) Notice: Subject to any disclaimer, the term of this patent is extended or adjusted under 35 U.S.C. 154(b) by 282 days.

(21) Appl. No.: 16/608,194

(22) PCT Filed: May 2, 2018

(86) PCT No.: PCT/CN2018/000159
§ 371 (c)(1),
(2) Date: Oct. 25, 2019

(87) PCT Pub. No.: WO2018/196437
PCT Pub. Date: Nov. 1, 2018

(65) Prior Publication Data

US 2021/0324864 A1 Oct. 21, 2021

(30) Foreign Application Priority Data

Apr. 29, 2017 (CN) ..... 201710307957.4

(51) Int. Cl.
*F04D 25/08* (2006.01)
*F04D 29/42* (2006.01)
(Continued)

(52) U.S. Cl.
CPC ..... *F04D 25/08* (2013.01); *F04D 29/4206* (2013.01); *F04D 29/441* (2013.01); *F04F 5/16* (2013.01); *F04F 5/46* (2013.01)

(58) Field of Classification Search
CPC .... F04F 5/46; F04F 5/16; F04D 25/08; F04D 29/441; F04D 29/4206; F04D 29/422;
(Continued)

(56) References Cited

U.S. PATENT DOCUMENTS 1,447,103 A * 2/1923 Schmidt ..... F04F 5/46 417/196
1,868,758 A * 7/1932 Nelson ..... F04F 5/46 417/198

(Continued)

FOREIGN PATENT DOCUMENTS

JP 5964873 B2 * 8/2016 ..... F04F 5/46

OTHER PUBLICATIONS

Machine Translation of JP 5964873 B2 to Aoki, S published Aug. 3, 2016 (Year: 2016).*

*Primary Examiner* — Essama Omgba
*Assistant Examiner* — Dnyanesh G Kasture

(57) ABSTRACT

An air outlet cylinder of a bladeless fan is provided, having an air cylinder and a nozzle; the air cylinder is provided with an air inlet for receiving airflows, and an internal channel; the front-end sidewall of the air cylinder is provided with an opening extending longitudinally therethrough; the inner wall surface at each of two sides of the opening in the air cylinder is separately provided with a limiting groove extending longitudinally therethrough; the nozzle has a mouth part embedded in the opening, and two airflow guiding parts respectively embedded in the corresponding limiting grooves; multiple air outlet slits are longitudinally spaced on the mouth part; airflows received in the internal channel are sprayed from the air outlet slits. A bladeless fan having the air outlet cylinder is also provided.

8 Claims, 10 Drawing Sheets

(51) Int. Cl.
*F04D 29/44* (2006.01)
*F04F 5/16* (2006.01)
*F04F 5/46* (2006.01)

(58) Field of Classification Search
CPC ..... B05B 1/04; B05B 1/042; B05B 1/044; B05B 1/046
USPC ..... 417/198; 239/589, 592, 594, 601
See application file for complete search history.

(56) References Cited

U.S. PATENT DOCUMENTS

| | | | | | |
|---|---|---|---|---|---|
| 4,419,074 | A * | 12/1983 | Schuetz | F23D 14/06 | 239/403 |
| 4,940,392 | A * | 7/1990 | Adkins | F04F 5/463 | 181/218 |
| 5,768,749 | A * | 6/1998 | Ohi | A01G 20/47 | 15/405 |
| 6,877,960 | B1 * | 4/2005 | Presz, Jr. | F04F 5/46 | 417/183 |
| 2013/0323100 | A1 * | 12/2013 | Poulton | F04D 27/002 | 417/423.14 |
| 2015/0136997 | A1 * | 5/2015 | Kubo | H01J 27/022 | 250/423 R |

* cited by examiner

BLADELESS FAN AND AIR OUTLET CYLINDER THEREOF

BACKGROUND OF THE INVENTION

The present invention relates to the technical field of fan, and more specifically relates to a bladeless fan and an air outlet cylinder thereof.

Nowadays, an air outlet portion of a bladeless fan is usually circular in shape, comprising a circular passage for receiving a basic air stream and a circular vent for ejecting the basic air stream, and also comprising a circular opening that guides external air to a proximity of the circular vent to mix with the basic air stream ejected out from the circular vent. Such an air outlet portion is structurally defective during use in respect of the following aspects:

1. The basic air stream ejected out from the circular vent is dispersed and not focused. Therefore, when the fan is used distal from the user, the user can only experience the air stream ejected out from the circular vent having a slow speed and a small volume. As such, wind generated by the fan is not effective to achieve quick cooling purpose for the user.

2. The circular passage create a circular pathway for the basic air stream inside the air outlet portion, but this leads to uneven distribution of the air stream in the circular passage, and thus the uneven ejection of air stream.

3. Large space is required and is therefore disadvantageous to disposition, use, and storage etc.

4. The fan is noisy, especially when the fan is required to provide high speed air stream. The noise is particularly acute when the impeller of the fan cuts into the air when it rotates at a high speed. As such, the noise significantly affects the environment of use.

BRIEF SUMMARY OF THE INVENTION

In view of the disadvantages now present in the prior art, the present invention provides a bladeless fan which is structurally small and which has a novel and aesthetical design. Also provided is an air outlet cylinder of the bladeless fan. The present invention can increase the wind power of the fan and the effective wind distance, with higher speed of the air stream and more even ejection of the air stream. Further, the present invention has reduced noise, occupies less space, and is easy to manufacture etc.

The objects of the present invention are achieved through the following technical solutions:

An air outlet cylinder of a bladeless fan, comprising a cylinder and a nozzle; the cylinder is provided with an air inlet that receives an air stream, and an internal passage; a front side wall of the cylinder is provided with an opening running longitudinally through an upper side and a lower side of the cylinder; a position limiting groove also running longitudinally through the upper side and the lower side of the cylinder is provided on an inner wall surface of the cylinder inside the cylinder at each of two sides of the opening; the nozzle comprises a mouth portion inserted into the opening, and a first air stream guiding portion and a second air stream guiding portion each inserted into the corresponding position limiting groove; a plurality of air outlet slits spaced apart from one another are arranged on the mouth portion longitudinally along a same longitudinally line; the air stream received by the internal passage is ejected externally through the plurality of air outlet slits under guiding effect of the first air stream guiding portion and the second air stream guiding portion.

Further, the plurality of air outlet slits have equal widths each being 1-5 mm.

Further, the plurality of air outlet slits have equal widths each being 1.5-3 mm.

Further, each of the first air stream guiding portion and the second air stream guiding portion has a slanted wing structure; the first air stream guiding portion and the second air stream guiding portion are configured to face each other to form a Y shape when viewing from the upper side of the cylinder, thereby forming an air stream guiding opening having a tapered shape tapered along an outlet direction of the air stream between the first air stream guiding portion and the second air stream guiding portion.

Further, each of the air outlet slits is flat and vertical; the mouth portion is provided with air collection openings also in tapered shape tapered along the outlet direction of the air stream, configured correspondingly at inner ends of the air outlet slits respectively; a narrower end of each air collection opening is in communication with the inner end of the corresponding air outlet slit; a wider end of each air collection opening is in communication with a narrower end of the air stream guiding opening.

Further, two side walls of each of the air collection openings are slanted surfaces tapered along the outlet direction of the air stream; an included angle between the first air stream guiding portion and the second air stream guiding portion is greater than an included angle between the two side walls of each of the air collection openings.

Further, each pair of adjacent air outlet slits are separated by a rib; the rib is integrally connected with two side walls of each of the corresponding pair of adjacent air outlet slits; an outer surface of the rib does not protrude out of a front surface of each of the corresponding pair of adjacent air outlet slits; a width of the rib extends from the outer surface thereof inwardly till the wider end of a corresponding air collection opening.

Further, two ends of the first air stream guiding portion is provided with a first abutting portion and a second abutting portion respectively that abut against two side walls of a corresponding position limiting groove respectively; two ends of the second air stream guiding portion is provided with a third abutting portion and a fourth abutting portion respectively that abut against two side walls of another corresponding position limiting groove respectively.

Further, the cylinder is made of metal, and has an elongated cylindrical structure; the upper side and the lower side of the cylinder are openings; the opening of the upper side is covered by a circular plastic seal cap; the opening of the lower side is said air inlet; the nozzle is a plastic structure integrally molded as a one whole piece.

A bladeless fan, comprising a base and an air outlet cylinder supported by the base; an air stream channel, an impeller generating an air stream, and a motor are provided inside the base; air inlet openings of the air stream channel are provided at an outer surface of the base; an air outlet end of the air stream channel is connected with the air outlet cylinder; the air outlet cylinder comprises a cylinder and a nozzle; the cylinder is provided with an air inlet that receives the air stream, and an internal passage; a front side wall of the cylinder is provided with an opening running longitudinally through an upper side and a lower side of the cylinder; a position limiting groove also running longitudinally through the upper side and the lower side of the cylinder is provided on an inner wall surface of the cylinder inside the cylinder at each of two sides of the opening; the nozzle comprises a mouth portion inserted into the opening, and a first air stream guiding portion and a second air stream guiding portion each inserted into the corresponding position limiting groove; a plurality of air outlet slits spaced apart from one another are arranged on the mouth portion longitudinally along a same longitudinally line; the air stream received by the internal passage is ejected externally through the plurality of air outlet slits under guiding effect by the first air stream guiding portion and the second air stream guiding portion.

The present invention has the following beneficial effects compared with the prior art:

Firstly, air outlets of the air outlet cylinder are configured as longitudinally arranged air outlet slits that facilitate the air stream to be compressed and focused before ejecting outwardly, thereby increasing the wind power of the fan the effective wind distance.

Secondly, the present invention provides the air stream guiding opening and the air collection openings in the cylinder. Since the air stream guiding opening and the air collection openings are configured as having a tapered guiding structure tapered along the outlet direction of the air stream, the speed of the air stream is multiplied when it flows towards the air outlet slits. As such, the speed of the ejected air stream is increased, and a higher volume of wind can be provided, thereby achieving quick cooling effect for the users.

Thirdly, the air outlet cylinder of the present invention has a small volume. Not only does it occupy less space and thus facilitating disposition and storage, but also it helps develop a stream of highly pressurized air quickly inside the cylinder for ejection, thereby further increasing the speed of ejection of the air stream. Also, the air outlet cylinder adopts a separable structure constituted by the cylinder and the nozzle, therefore the air outlet cylinder is specifically suitable to be made by two different kinds of materials, for example, metal for the cylinder and plastics for the nozzle. As such, the air outlet cylinder can appear more high-class and aesthetically pleasing. Also, production of the product can be facilitated, and the yield rate of the product can be increased.

Finally, the internal passage of the air outlet cylinder is configured as a longitudinal passage. Therefore, air stream in the internal passage can be evenly distributed, thereby ensuring that the air stream is evenly ejected.

BRIEF DESCRIPTION OF THE DRAWINGS

FIG. 0.4 is a sectional view along line A-A of FIG. 3.

DETAILED DESCRIPTION OF THE INVENTION

Figure 1:
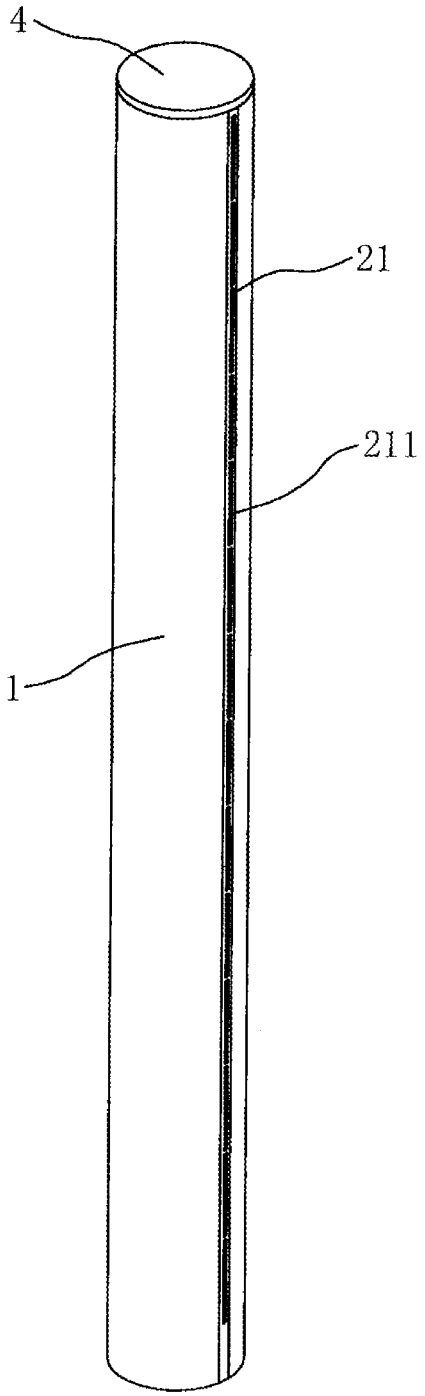
FIG. 1 is a schematic perspective view of the air outlet cylinder of the bladeless fan of the present invention.
Figure 2:
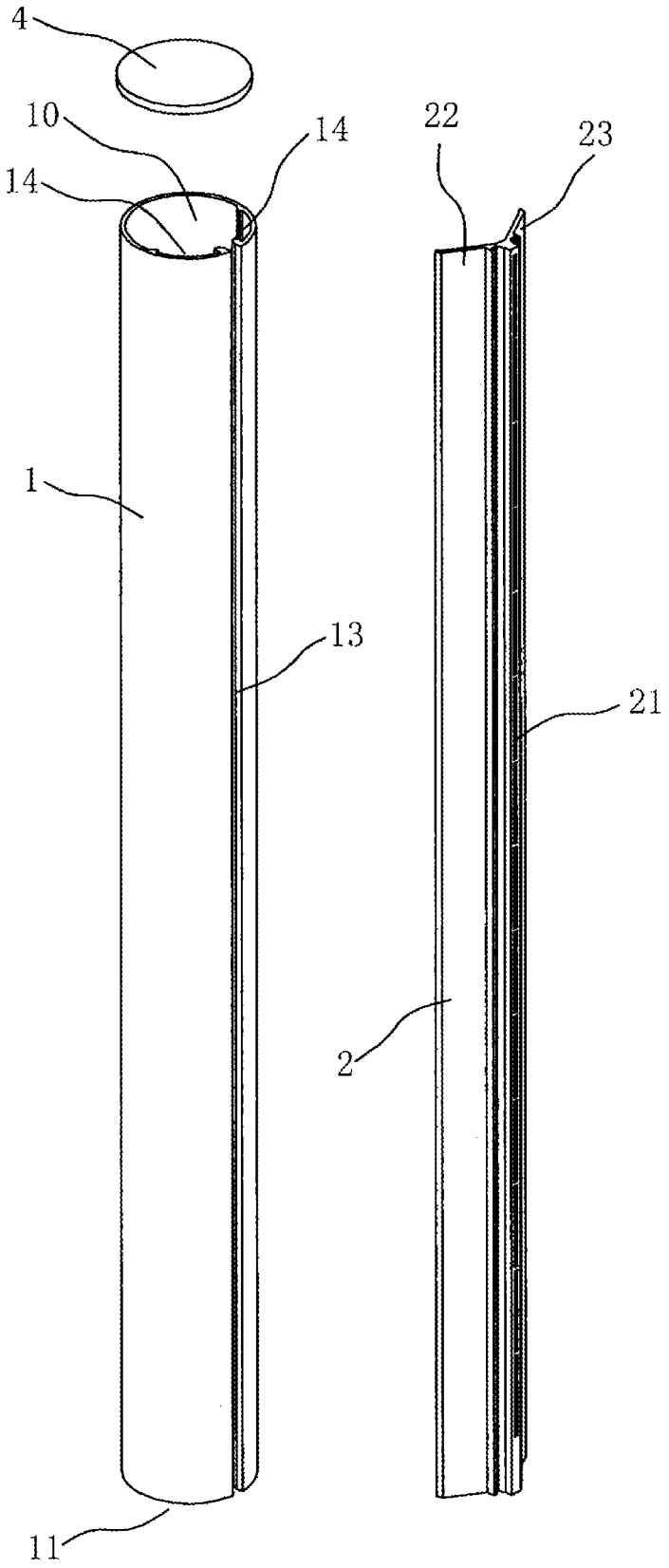
FIG. 2 is an exploded view of the air outlet cylinder of the bladeless fan of the present invention.
Figure 3:
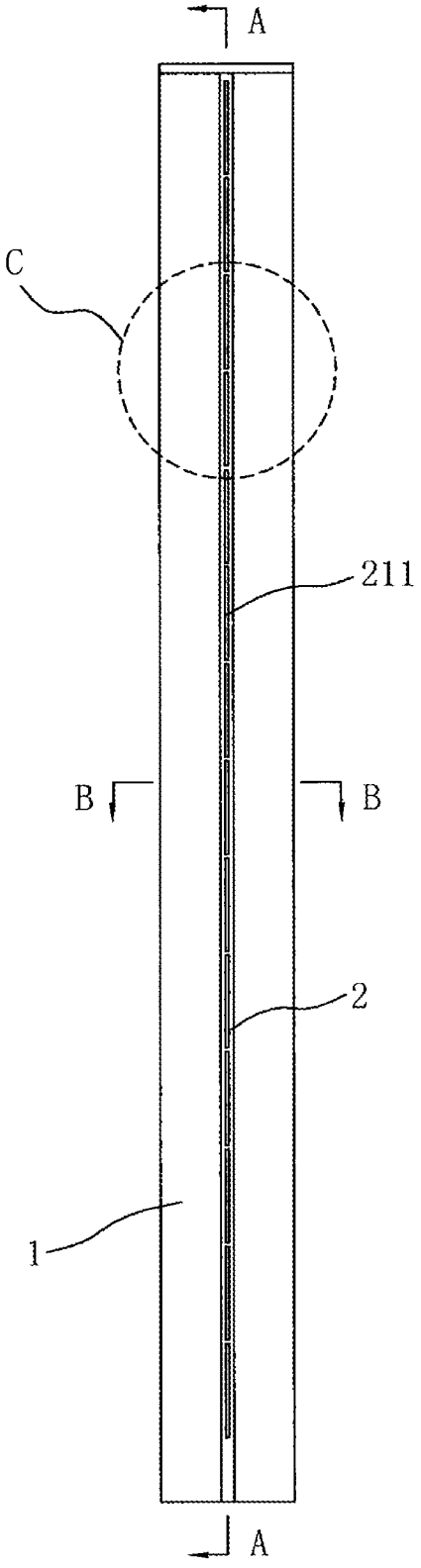
FIG. 3 is a front view of the air outlet cylinder of the bladeless fan of the present invention.
Figure 4:
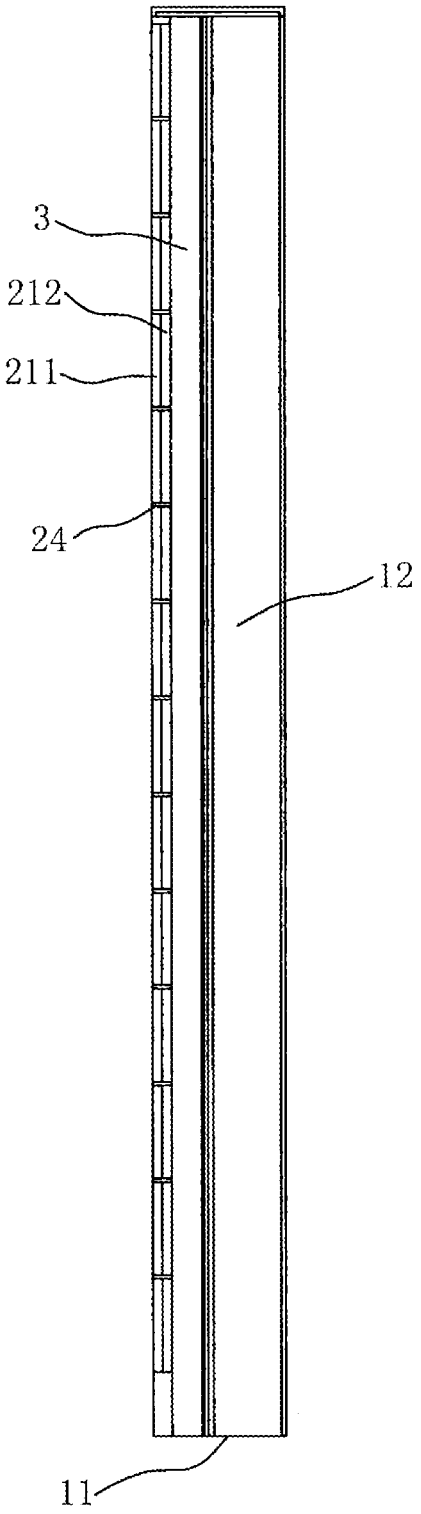
Figure 5:
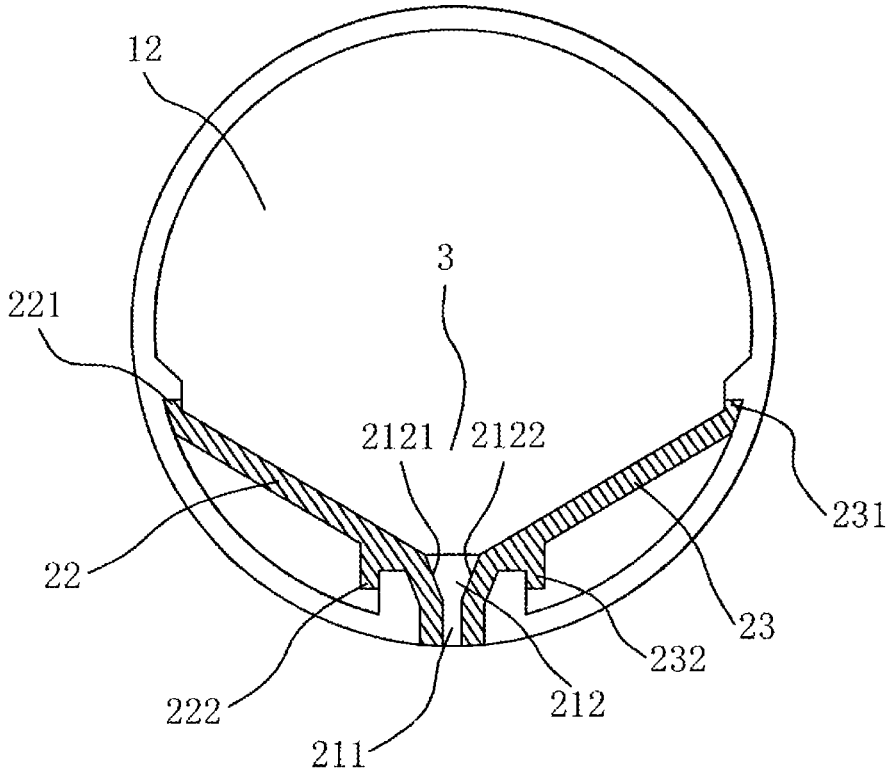
FIG. 5 is a sectional view along line B-B of FIG. 3.
Figure 6:
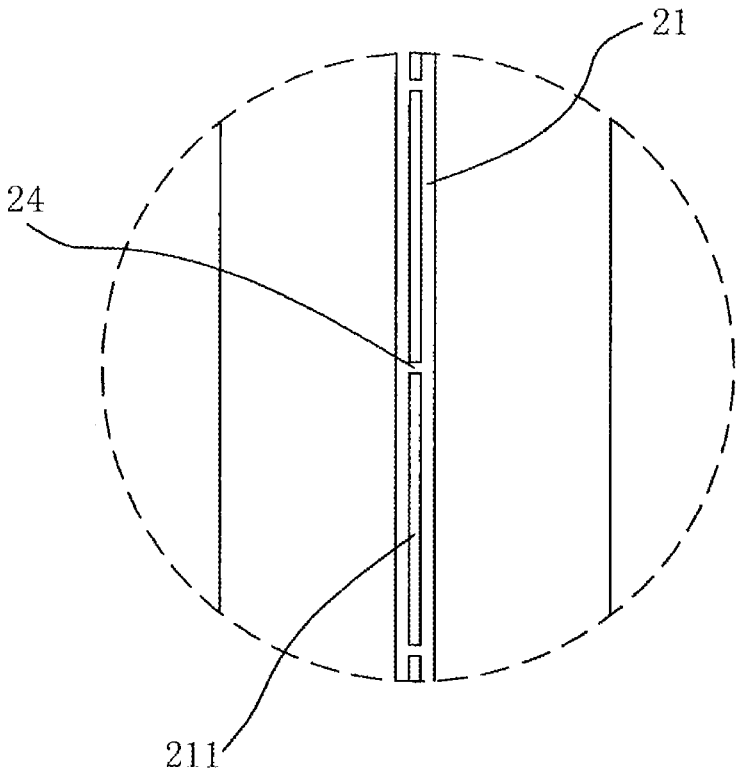
FIG. 6 is an enlarged view of portion C indicated in FIG. 3.
Figure 7:
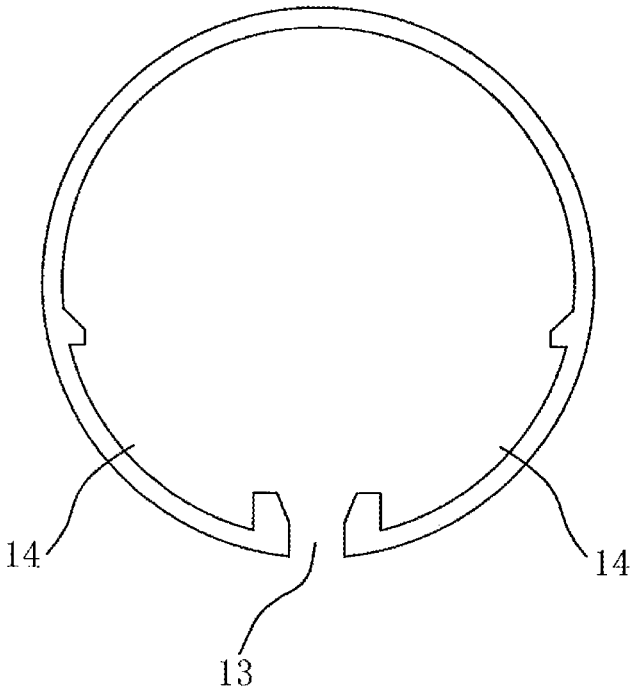
FIG. 7 is a top plan view of the cylinder of the present invention.
Figure 8:
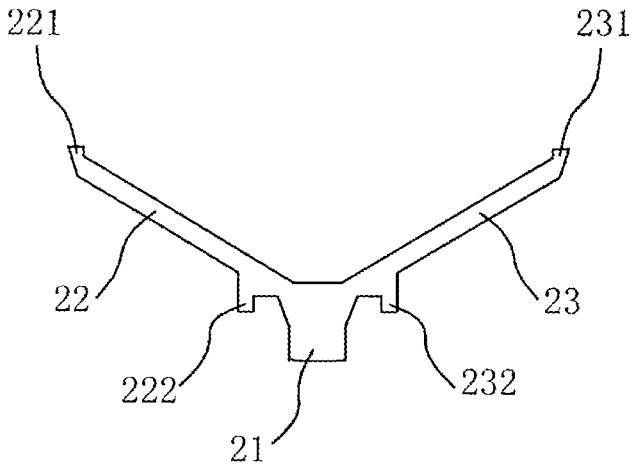
FIG. 8 is a top plan view of the nozzle of the present invention.

The present invention will be further described in detail below with reference to an embodiment as illustrated by the accompanying drawings.

FIGS. 1-8 illustrate a preferred embodiment of an air outlet cylinder of a bladeless fan according to the present invention, comprising a cylinder 1 and a nozzle 2; the cylinder is provided with an air inlet 11 that receives air stream, and an internal passage 12; a front side wall of the cylinder 1 is provided with an opening 13 running longitudinally through an upper side and a lower side of the cylinder; a position limiting groove 14 also running longitudinally through the upper side and the lower side of the cylinder is provided on an inner wall surface of the cylinder inside the cylinder at each of two sides of the opening 13. The nozzle 2 comprises a mouth portion 21 inserted into the opening 13, and a first air stream guiding portion 22 and a second air stream guiding portion 23 each inserted into a corresponding position limiting groove 14. A plurality of air outlet slits 211 spaced apart from one another are arranged on the mouth portion 21 longitudinally along a same longitudinally line; the air stream received by the internal passage 12 is ejected externally through the plurality of air outlet slits 211.

Preferably, the plurality of air outlet slits 211 have equal widths being 1-5 mm; more preferably, the plurality of air outlet slits 211 have equal widths being 1.5-3 mm.

Each of the first air stream guiding portion 22 and the second air stream guiding portion 23 has a slanted wing structure; the first air stream guiding portion 22 and the second air stream guiding portion 23 are configured to face each other to form a Y shape when viewing from a top side of the cylinder, thereby forming an air stream guiding opening 3 having a tapered shape tapered along an outlet direction of the air stream between the first air stream guiding portion 22 and the second air stream guiding portion 23. Each of the air outlet slits 211 is flat and vertical. The mouth portion 21 is provided with air collection openings 212 also in tapered shape tapered along the outlet direction of the air stream, configured correspondingly at inner ends of the air outlet slits 211 respectively. A narrower end of each air collection opening 212 is in communication with the inner end of the corresponding air outlet slit 211. The wider end of each air collection opening 212 is in communication with a narrower end of the air stream guiding opening 3. According to these structural arrangements, speed of the air stream is multiplied when the air stream guiding opening 3 guides the air stream in the internal passage 12 towards the air collection openings 212, and the speed of the air stream further increases when the air collection openings 212 guide the air stream towards the respective air outlet slits 211. As a result, a high speed jet of air stream will come out from the air outlet slits 211.

Two side walls 2121, 2122 of each of the air collection openings 212 are slanted surfaces tapered along the outlet direction of the air stream. An included angle between the first air stream guiding portion 22 and the second air stream guiding portion 23 is greater than an included angle between the two side walls 2121, 2122 of each of the air collection openings 212. Preferably, the included angle between the first air stream guiding portion 22 and the second air stream guiding portion 23 is 90-150 degrees, and the included angle between the two side walls 2121, 2122 of each of the air collection openings 212 is 30-60 degrees.

Each pair of adjacent air outlet slits 211 are separated by a rib 24, so that the air stream can be evenly distributed during ejection. The rib 24 is integrally connected with two side walls of each of the corresponding pair of adjacent air outlet slits 211; an outer surface of the rib 24 does not protrude out of a front surface of each of the corresponding pair of adjacent air outlet slits 211. A width of the rib extends from the outer surface thereof inwardly till the wider end of a corresponding air collection opening 212.

Two ends of the first air stream guiding portion 22 is provided with a first abutting portion 221 and a second abutting portion 222 respectively that abut against two side walls of a corresponding position limiting groove 14 respectively. Two ends of the second air stream guiding portion 23 is provided with a third abutting portion 231 and a fourth abutting portion 232 respectively that abut against two side walls of another corresponding position limiting groove 14 respectively.

The cylinder 1 is made with metal, and has an elongated cylindrical structure. The upper side and the lower side of the cylinder are openings. The opening 10 of the upper side is covered by a circular plastic seal cap 4; the opening of the lower side is said air inlet 11. The nozzle 2 is a plastic structure integrally molded as a one whole piece. Preferably, the cylinder 1 has a dimeter of 30-100 mm, and a height of 300-1000 mm.

The principle of the structural arrangements of the cylinder is described as follows: A cylinder that is relatively sealed is used to receive an air stream, and the air stream forms a pressurized stream under a certain air pressure, and this pressurized stream is further compressed and guided by the air stream guiding opening and the air collection openings, and is eventually blown out of the air outlet slits at a front side of the cylinder, thereby generating a jet stream ejected outwardly at a high speed.

Figure 9:
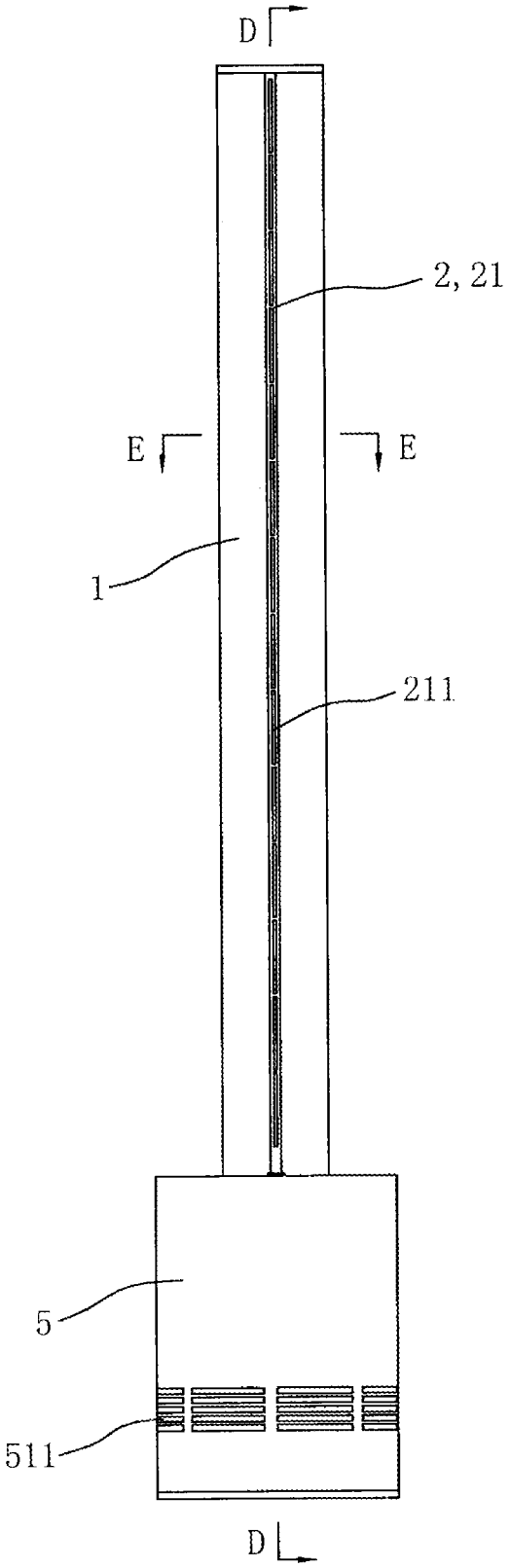
FIG. 9 is a front view of the bladeless fan of the present invention.
Figure 10:
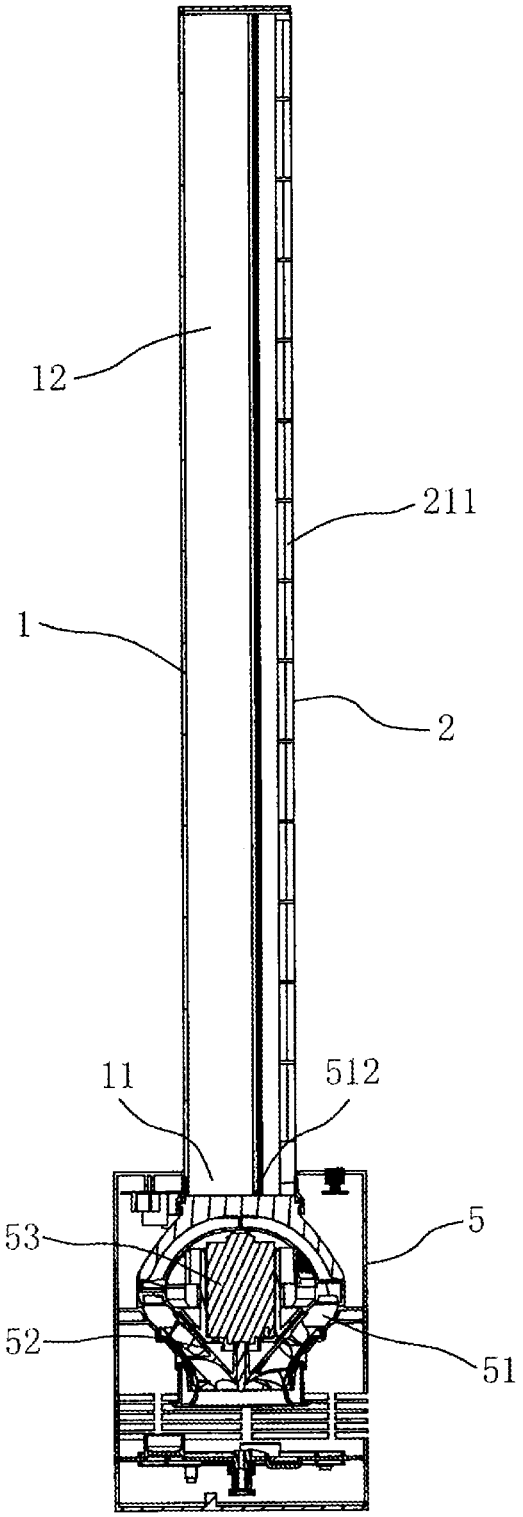
FIG. 10 is a sectional view along line D-D of FIG. 9.
Figure 11:
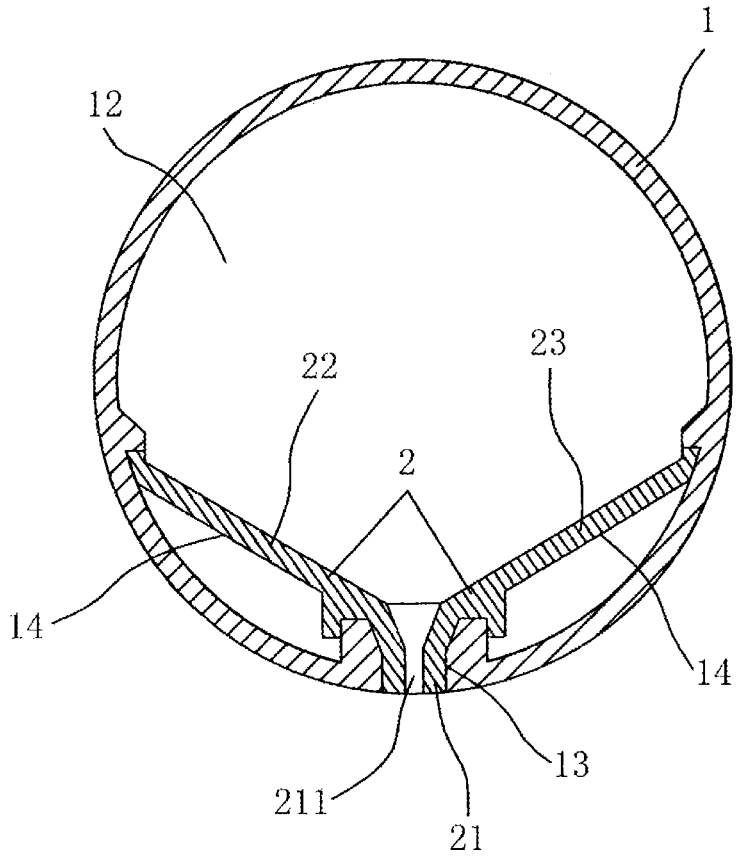
FIG. 11 is a sectional view along line E-E of FIG. 9.

As shown in FIGS. 9-11, a bladeless fan provided by the present invention comprises a base 5 and an air outlet cylinder supported by the base 5; an air stream channel 51, an impeller 52 generating an air stream, and a motor 53 are provided inside the base 5; air inlet openings 511 of the air stream channel 51 are provided at an outer surface of the base 5; an air outlet end 512 of the air stream channel is connected with the air outlet cylinder; the air outlet cylinder comprises a cylinder 1 and a nozzle 2; the cylinder 1 is provided with an air inlet 11 that receives the air stream, and an internal passage 12; a front side wall of the cylinder 1 is provided with an opening 13 running longitudinally through an upper side and a lower side of the cylinder; a position limiting groove 14 also running longitudinally through the upper side and the lower side of the cylinder is provided on an inner wall surface of the cylinder inside the cylinder at each of two sides of the opening 13; the nozzle 2 comprises a mouth portion 21 inserted into the opening 13, and a first air stream guiding portion 22 and a second air stream guiding portion 23 each inserted into a corresponding position limiting groove 14; a plurality of air outlet slits 211 spaced apart from one another are arranged on the mouth portion 21 longitudinally along a same longitudinally line; the air stream received by the internal passage 12 is ejected externally through the plurality of air outlet slits 211 under guiding effect by the first air stream guiding portion 22 and the second air stream guiding portion 23.

The description above illustrates only a preferred embodiment of the present invention, and should not limit the scope of implementing the present invention. Any simple changes and modifications achieving the same technical effect as the present invention, made in accordance with the scope of the present invention and the contents of the description, should also fall within the scope of the present invention.

What is claimed is:

1. An air outlet cylinder of a bladeless fan, comprising a cylinder and a nozzle; the cylinder is provided with an air inlet that receives an air stream, and an internal passage; a front side wall of the cylinder is provided with an opening running longitudinally through an upper side and a lower side of the cylinder; a position limiting groove also running longitudinally through the upper side and the lower side of the cylinder is provided on an inner wall surface of the cylinder inside the cylinder at each of two sides of the opening; the nozzle comprises a mouth portion inserted into the opening, and a first air stream guiding portion and a second air stream guiding portion each inserted into the corresponding position limiting groove; a plurality of air outlet slits spaced apart from one another are arranged on the mouth portion longitudinally along a same longitudinal line; the air stream received by the internal passage is ejected externally through the plurality of air outlet slits under guiding effect of the first air stream guiding portion and the second air stream guiding portion; two ends of the first air stream guiding portion are provided with a first abutting portion and a second abutting portion respectively that abut against two side walls of a corresponding position limiting groove respectively; two ends of the second air stream guiding portion are provided with a third abutting portion and a fourth abutting portion respectively that abut against two side walls of another corresponding position limiting groove respectively.

2. The air outlet cylinder as in claim 1, wherein the plurality of air outlet slits have equal widths each being 1-5 mm.

3. The air outlet cylinder as in claim 2, wherein the plurality of air outlet slits have equal widths each being 1.5-3 mm.

4. The air outlet cylinder as in claim 1, wherein each of the first air stream guiding portion and the second air stream guiding portion has a slanted wing structure; the first air stream guiding portion and the second air stream guiding portion are configured to face each other to form a Y shape when viewing from the upper side of the cylinder, thereby forming an air stream guiding opening having a tapered shape tapered along an outlet direction of the air stream between the first air stream guiding portion and the second air stream guiding portion.

5. The air outlet cylinder as in claim 4, wherein each of the air outlet slits is flat and vertical; the mouth portion is provided with air collection openings also in tapered shape tapered along the outlet direction of the air stream, configured correspondingly at inner ends of the air outlet slits respectively; a narrower end of each air collection opening is in communication with an inner end of a corresponding air outlet slit; a wider end of each air collection opening is in communication with a narrower end of the air stream guiding opening.

6. The air outlet cylinder as in claim 5, wherein two side walls of each of the air collection openings are slanted surfaces tapered along the outlet direction of the air stream; an included angle between the first air stream guiding portion and the second air stream guiding portion is greater than an included angle between the two side walls of each of the air collection openings.

7. The air outlet cylinder as in claim 5, wherein a pair of adjacent air outlet slits are separated by a rib; the rib is integrally connected with two side walls of each of the corresponding pair of adjacent air outlet slits; an outer surface of the rib does not protrude out of a front surface of each of the corresponding pair of adjacent air outlet slits; a width of the rib extends from the outer surface thereof inwardly till the wider end of a corresponding air collection opening.

8. The air outlet cylinder as in claim 1, wherein the cylinder is made of metal, and has an elongated cylindrical structure; the upper side and the lower side of the cylinder are openings; the opening of the upper side is covered by a circular plastic seal cap; the opening of the lower side is said air inlet; the nozzle is a plastic structure integrally molded as a one whole piece.

* * * * *